US007637062B2

(12) United States Patent
Rerup

(10) Patent No.: US 7,637,062 B2
(45) Date of Patent: Dec. 29, 2009

(54) PANEL SECTION FOR SOUND BARRIER

(75) Inventor: Hans J. Rerup, Hamilton (CA)

(73) Assignee: Durisol Inc., Hamilton, Ontario (CA)

( * ) Notice: Subject to any disclaimer, the term of this patent is extended or adjusted under 35 U.S.C. 154(b) by 530 days.

(21) Appl. No.: 10/864,453

(22) Filed: Jun. 10, 2004

(65) Prior Publication Data

US 2005/0284059 A1 Dec. 29, 2005

(51) Int. Cl.

| | |
|---|---|
| ***E04B 1/82*** | (2006.01) |
| ***E04C 1/42*** | (2006.01) |
| ***E04H 17/00*** | (2006.01) |
| ***G10K 11/00*** | (2006.01) |

(52) U.S. Cl. ..... 52/144; 52/306; 181/210; 181/211

(58) Field of Classification Search ..... 52/144, 52/145, 306; 181/210, 289, 284, 285
See application file for complete search history.

(56) References Cited

U.S. PATENT DOCUMENTS

| | | | | |
|---|---|---|---|---|
| 4,214,411 | A * | 7/1980 | Pickett | 52/144 |
| 4,325,457 | A * | 4/1982 | Docherty et al. | 181/210 |
| 4,779,324 | A * | 10/1988 | Sandor, Sr. | 29/451 |
| 5,406,039 | A * | 4/1995 | Rerup et al. | 181/210 |
| 5,984,044 | A * | 11/1999 | Christensen | 181/210 |
| 6,553,733 | B1 * | 4/2003 | Hock et al. | 52/306 |
| 2005/0178613 | A1 * | 8/2005 | Humphries et al. | 181/285 |

FOREIGN PATENT DOCUMENTS

| | | | |
|---|---|---|---|
| JP | 07018632 | A * | 1/1995 |
| JP | 09041329 | A * | 2/1997 |

* cited by examiner

*Primary Examiner*—Richard E Chilcot, Jr.
*Assistant Examiner*—Elizabeth A Plummer
(74) *Attorney, Agent, or Firm*—Patrick J. Hofbauer

(57) ABSTRACT

An improved panel section for use in a sound barrier is disclosed and is of the type: having a cementitious body; for use with at least two vertically-extending, ground-mounted I-beam columns, each having two parallel flanges and a transverse web extending therebetween and being positioned with its web substantially parallel to the web of adjacent columns and substantially normal to a line defined by said columns; and disposed, in use, in respective vertically-stacked groupings to form one or more wall panels interleaved between adjacent pairs of columns, each panel having a pair of end edges disposed, one each, in mechanically-engaged relation, between the flanges of a respective pair of adjacent columns. The improvement comprises: the body having defined therethrough an opening; and a glazing element secured to said body to occlude said opening and impede sound passage therethrough. A sound barrier constructed from the improved panel section is also disclosed.

12 Claims, 10 Drawing Sheets

PANEL SECTION FOR SOUND BARRIER

FIELD OF THE INVENTION

The present invention relates to the field of sound barriers, and more particularly, to sound barriers which include translucent or transparent glazing elements.

BACKGROUND OF THE INVENTION

The need for the control of, inter alia, highway, railway, industrial and rapid transit noise in urban areas is well recognized, and sound barriers for this purpose are widely utilized.

One common sound barrier includes a plurality of vertically-extending, ground-mounted metal I-beam columns, having interleaved therebetween a plurality of wall panels. Exemplary in this regard is the sound barrier disclosed in U.S. Pat. No. 4,325,457 (Docherty et al.), issued Apr. 20, 1982, which utilizes relatively light-weight cementitious panels. This sound barrier is known to be relatively inexpensive to manufacture and erect, and to provide acceptable levels of noise control. However, its wall panels, being cementitious, are completely opaque, and thereby block the transmission of light and the view of persons in the vicinity, which in certain circumstances can be undesirable, inter alia, from the standpoints of aesthetics and safety.

Large sheets of glass could, in principle, be used as wall panels in sound barriers. However, the cost of suitable glass, to wit, of sufficient strength to serve such purpose, is relatively high. Further, glass suffers from a propensity to shatter into sharp shards upon impact, thereby rendering it difficult and dangerous to work with, and unsuitable for use in situations wherein impacts could be expected, such as, for example, alongside highways.

Large sheets of synthetic transparent or translucent material that does not suffer from a propensity to shatter into sharp shards, such as acrylic or polycarbonate, are, in principle, also available for use as wall panels in sound barriers. However, not only is the cost of such materials relatively high, but, by virtue, inter alia, of the thermal expansion properties of available synthetic materials, it can be difficult to secure panels constructed therefrom to suitable supports. Moreover, supports that are constructed to accommodate panel movement during thermal expansion and contraction tend to increase the risk of withdrawal of the panels from their supports when the panels bow under wind or other loading; stiffening the panels against bowing by increasing their thickness adds detrimentally to cost and can impair light transmission, and similarly, increasing the size and complexity of the supports adds detrimentally to cost and can detract from the aesthetics of the wall. For reasons such as these, the use of transparent or translucent sheets of synthetic materials as wall panel components in sound barriers has been limited.

SUMMARY OF THE INVENTION

It is an object of the present invention to provide a transparent or translucent wall panel section for acoustical attenuation of a sound source that is relatively inexpensive to manufacture and erect.

This object, amongst others, is obtained by the present invention.

According to one aspect of the invention there is provided an improved panel section for use in a sound barrier for acoustical attenuation of a sound source.

The improved panel section is of the type: having a cementitious body portion; for use with at least two vertically-extending, ground-mounted I-beam columns, each such column having two parallel flanges and a transverse web extending therebetween and being positioned such that its web is substantially parallel to the web of each adjacent column and is substantially normal to a notional wall line defined by said columns; and disposed, in use, in respective vertically-stacked groupings to form one or more wall panels interleaved between adjacent pairs of columns, each wall panel having a pair of end edges disposed, one each, in mechanically-engaged relation, between the parallel flanges of a respective pair of adjacent columns.

The improvement comprises: the body portion having defined therethrough a window opening for permitting light transmission through said sound barrier in use; a glazing element adapted for light transmission; and fastening means for securing said glazing element to said body portion to occlude said window opening and to impede the passage of sound therethrough.

According to another aspect of the invention, an improved sound barrier is provided. The improved sound barrier is of the type having: at least two vertically-extending, ground-mounted I-beam columns, each such column having two parallel flanges and a transverse web extending therebetween and being positioned such that its web is substantially parallel to the web of each adjacent column and is substantially normal to a notional wall line defined by said columns; and a plurality of panel sections disposed in respective vertically-stacked groupings to form one or more wall panels interleaved between adjacent pairs of columns, each wall panel having a pair of end edges disposed, one each, in mechanically-engaged relation, between the parallel flanges of a respective pair of adjacent columns.

The improvement comprises: at least one of said panel sections being an improved panel section including a cementitious body portion having defined therethrough a window opening for permitting the passage of light through said sound barrier; a glazing element adapted for light transmission; and fastening means for securing said glazing element to said body portion to occlude said window opening and to impede the passage of sound therethrough.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

In the accompanying drawings, which are for the purpose of illustration and description only, and are not intended as a definition of the limits of the invention.

DETAILED DESCRIPTION OF A PREFERRED EMBODIMENT

Figure 1:
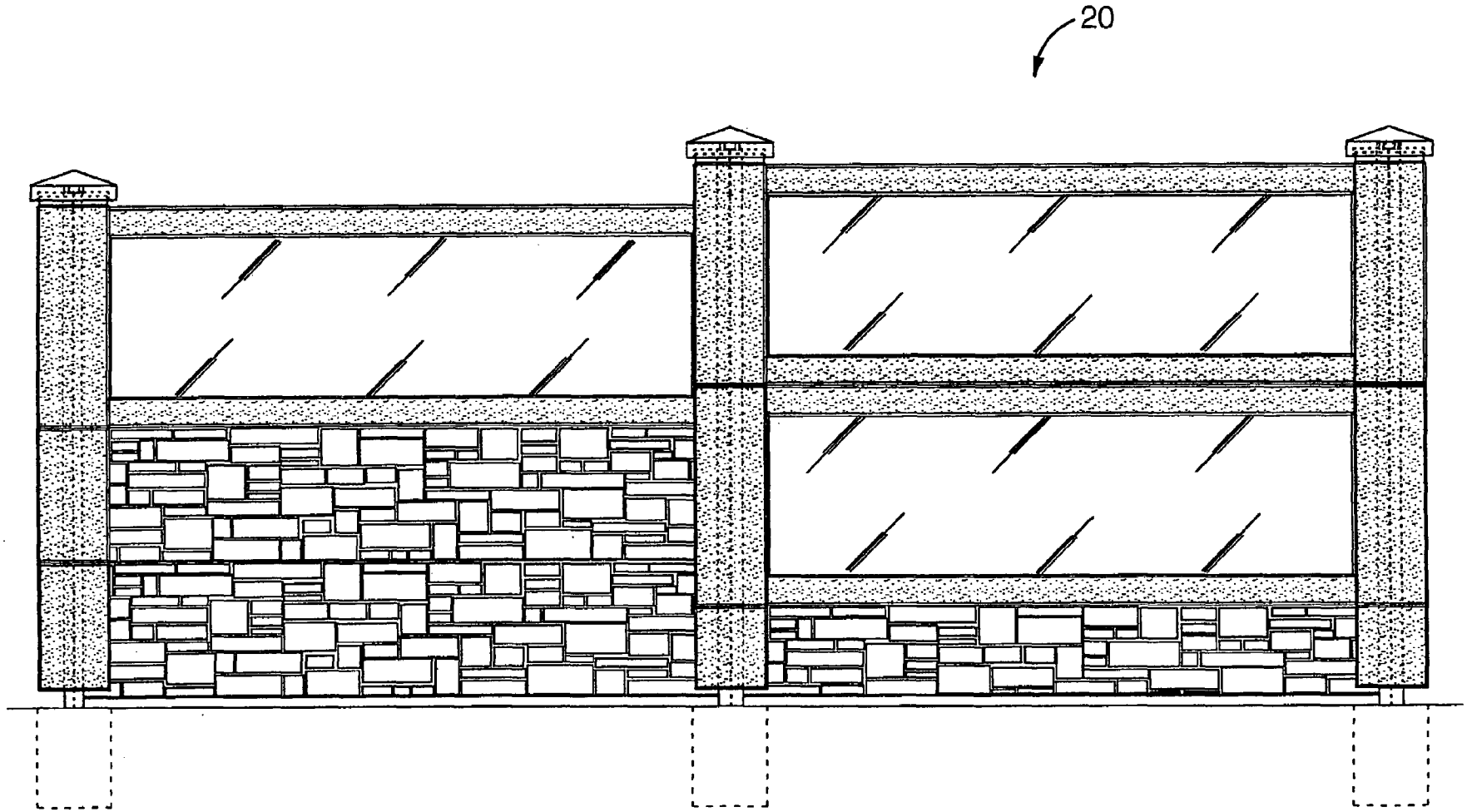
FIG. 1 is a front elevational view of an improved sound barrier according to a preferred embodiment of the present invention.
Figure 2:
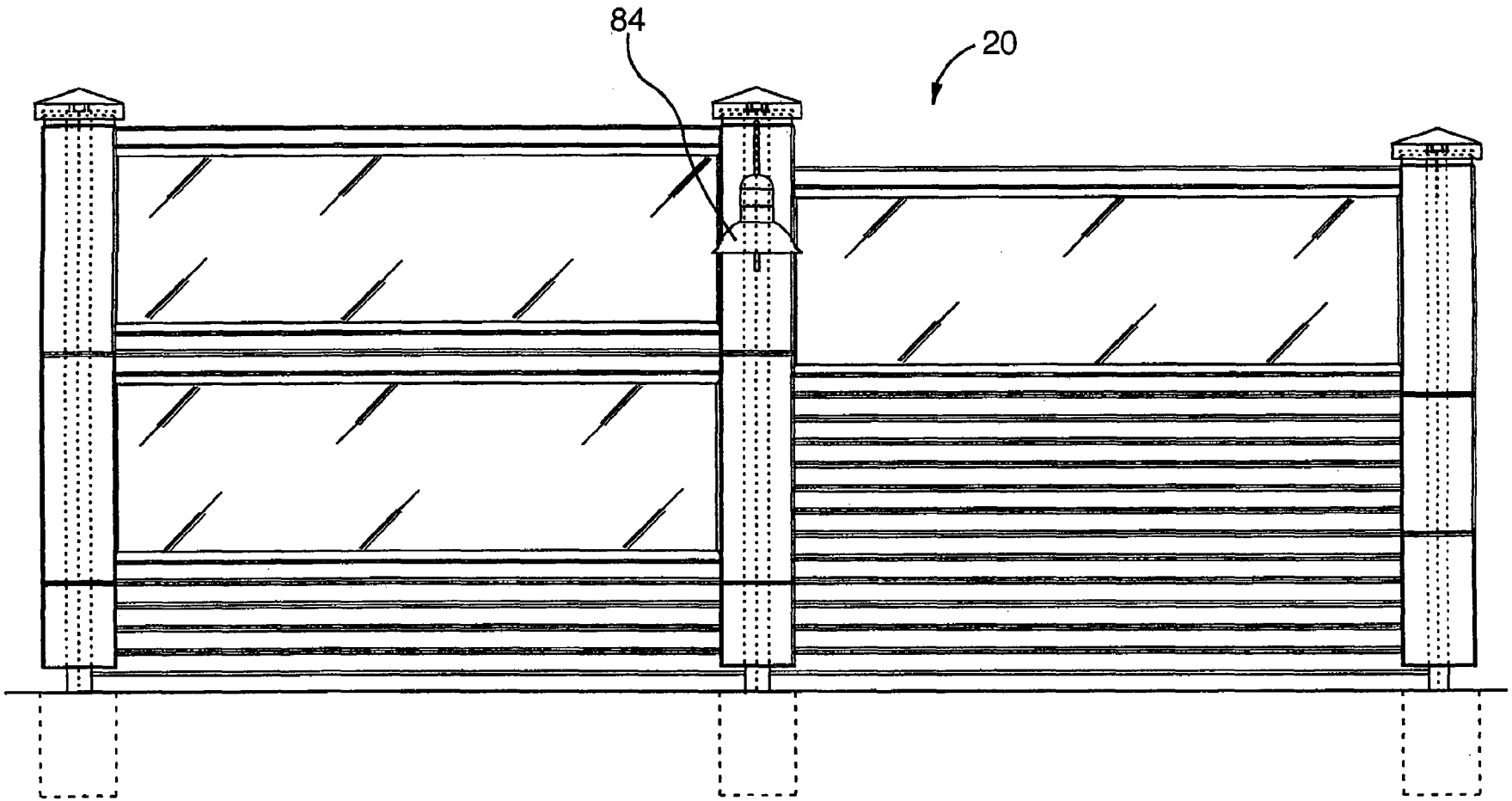
FIG. 2 is a rear elevational view of the sound barrier of FIG. 1.

Referring to FIGS. 1 and 2, an improved sound barrier for acoustical attenuation of a sound source (not shown) and according to a preferred embodiment of the present invention is illustrated and designated with general reference numeral 20.

Figure 3:
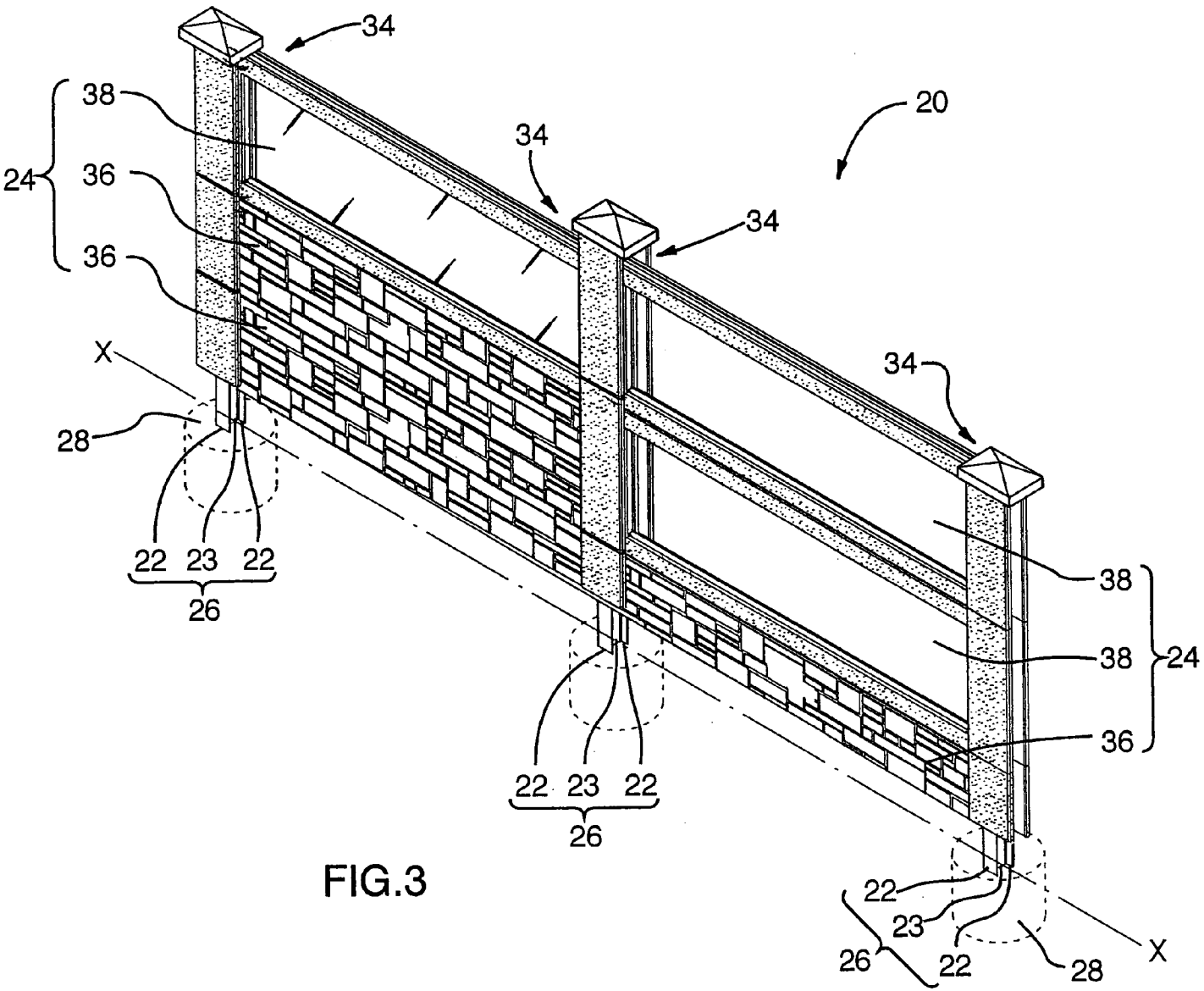
FIG. 3 is a front, top, right perspective view of the sound barrier of FIG. 1.

With general reference to FIG. 3, the improved sound barrier 20 of the preferred embodiment illustrated comprises at least two vertically-extending, ground-mounted steel I-beam columns 26 (three columns 26 are shown) and a plurality of panel sections 36,38. Each column 26 has two parallel flanges 22 and a transverse web 23 extending therebetween, is positioned such that its web 23 is substantially parallel to the web 23 of each adjacent column 26 and substantially normal to a notional wall line X-X defined by said columns 26, and is mounted in the ground by a respective concrete footing 28. The columns 26 and the footings 28 therefor are engineered to withstand wind loadings according to principles well-known to persons of ordinary skill in the art and therefor not detailed herein.

Figure 4:
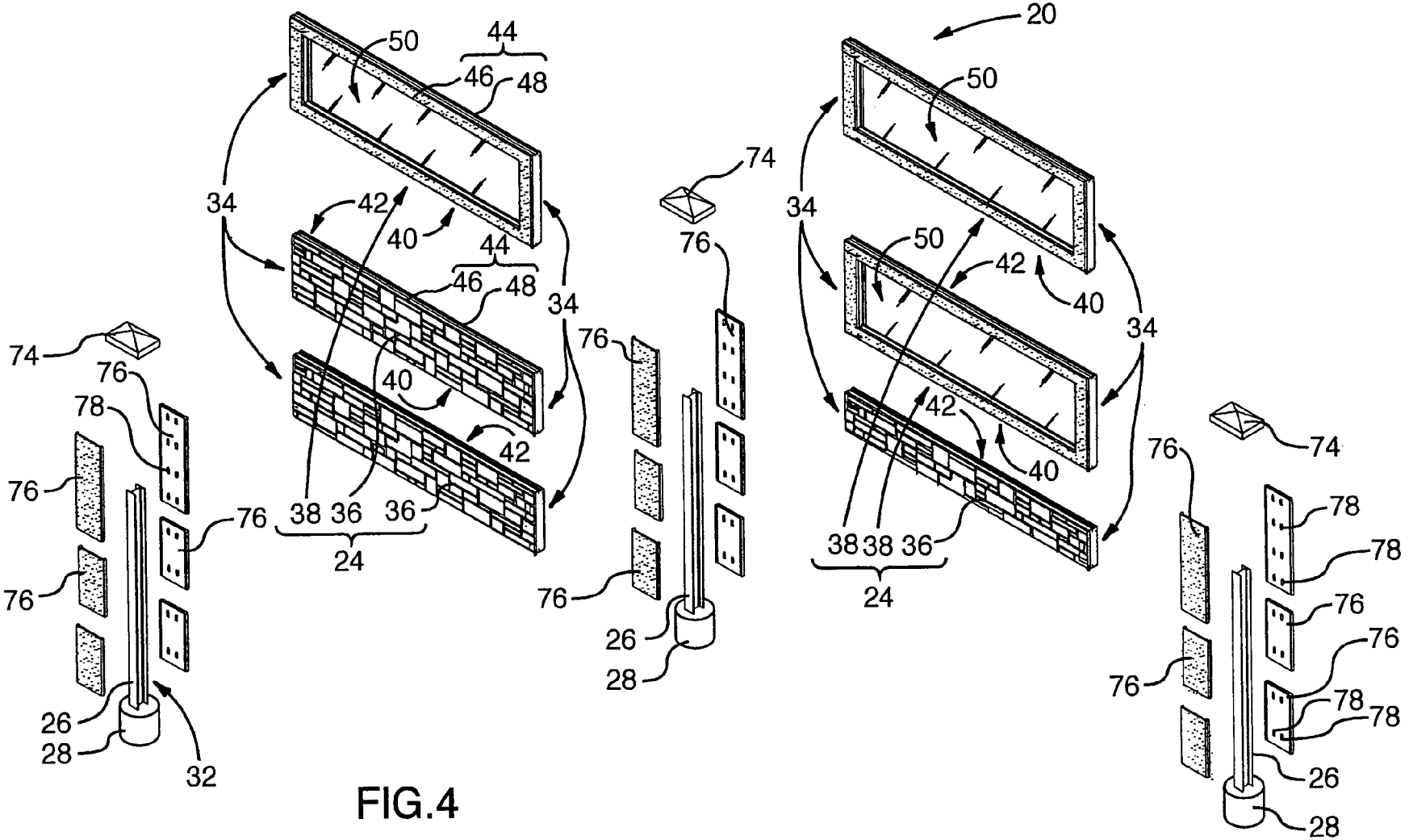
FIG. 4 is an exploded perspective view of the structure of FIG. 3.

As best seen in FIGS. 3 and 4, panel sections 36,38 are disposed in respective vertically-stacked groupings, with the panel sections 36,38 of each grouping being connected to one another with tongue 40 and groove 42 joints to form one or more wall panels 24, the tongue 40 and groove 42 joints providing a substantially air-tight joint between vertically adjacent panel sections 36,38, to reduce sound transmission therebetween. The wall panels 24, in turn, are interleaved between adjacent pairs of columns 26, with each panel 24 having a pair of end edges 34, defined, as best indicated in FIG. 4, by the end portions of the panel sections 36,38 forming said each wall panel 24, and disposed, one each, in mechanically-engaged relation, between the parallel flanges 22 of a respective pair of adjacent columns 26.

Figure 5:
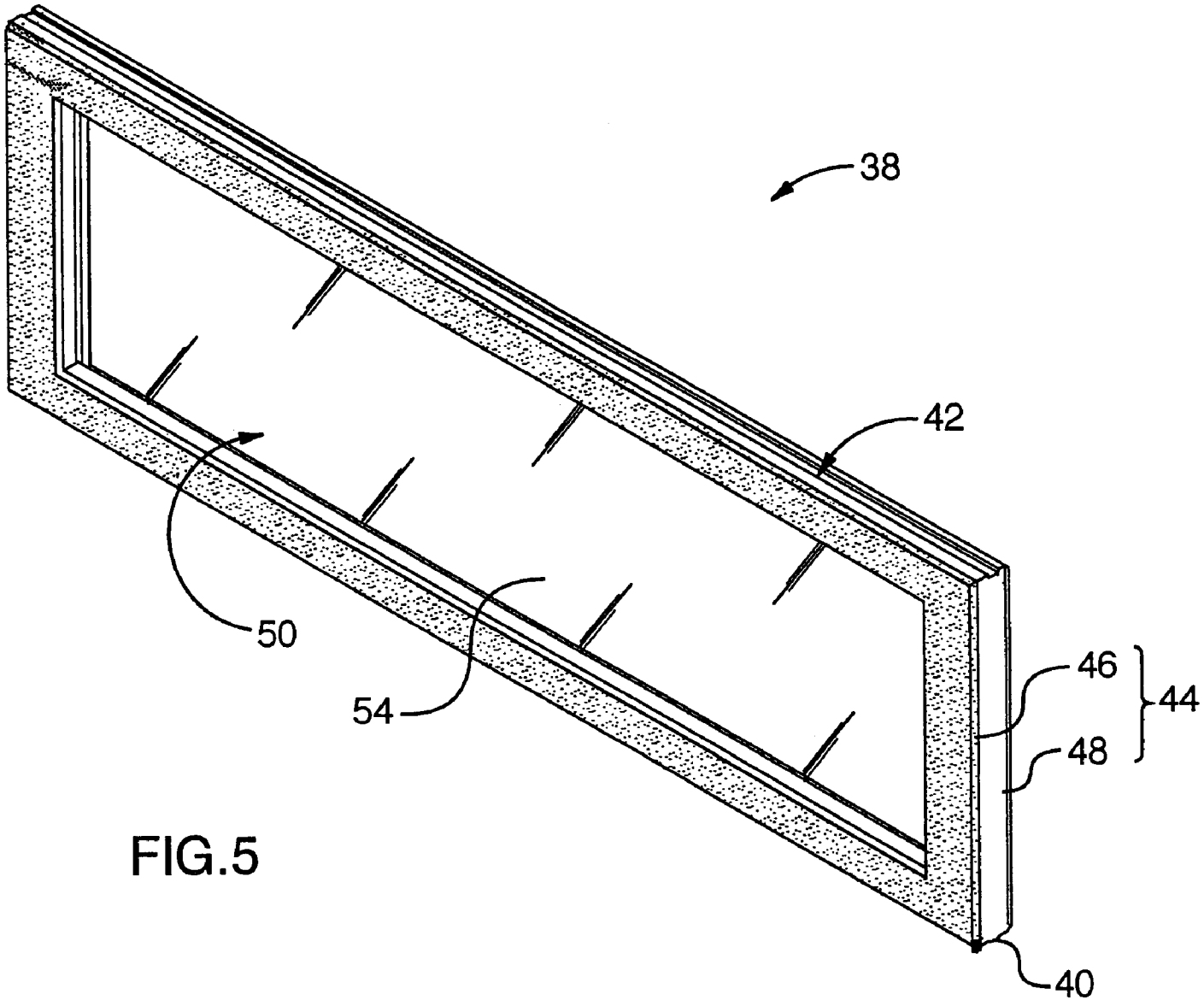
FIG. 5 is an enlarged perspective view of a portion of the structure of FIG. 4 showing an improved panel section according to the preferred embodiment of the invention.
Figure 6:
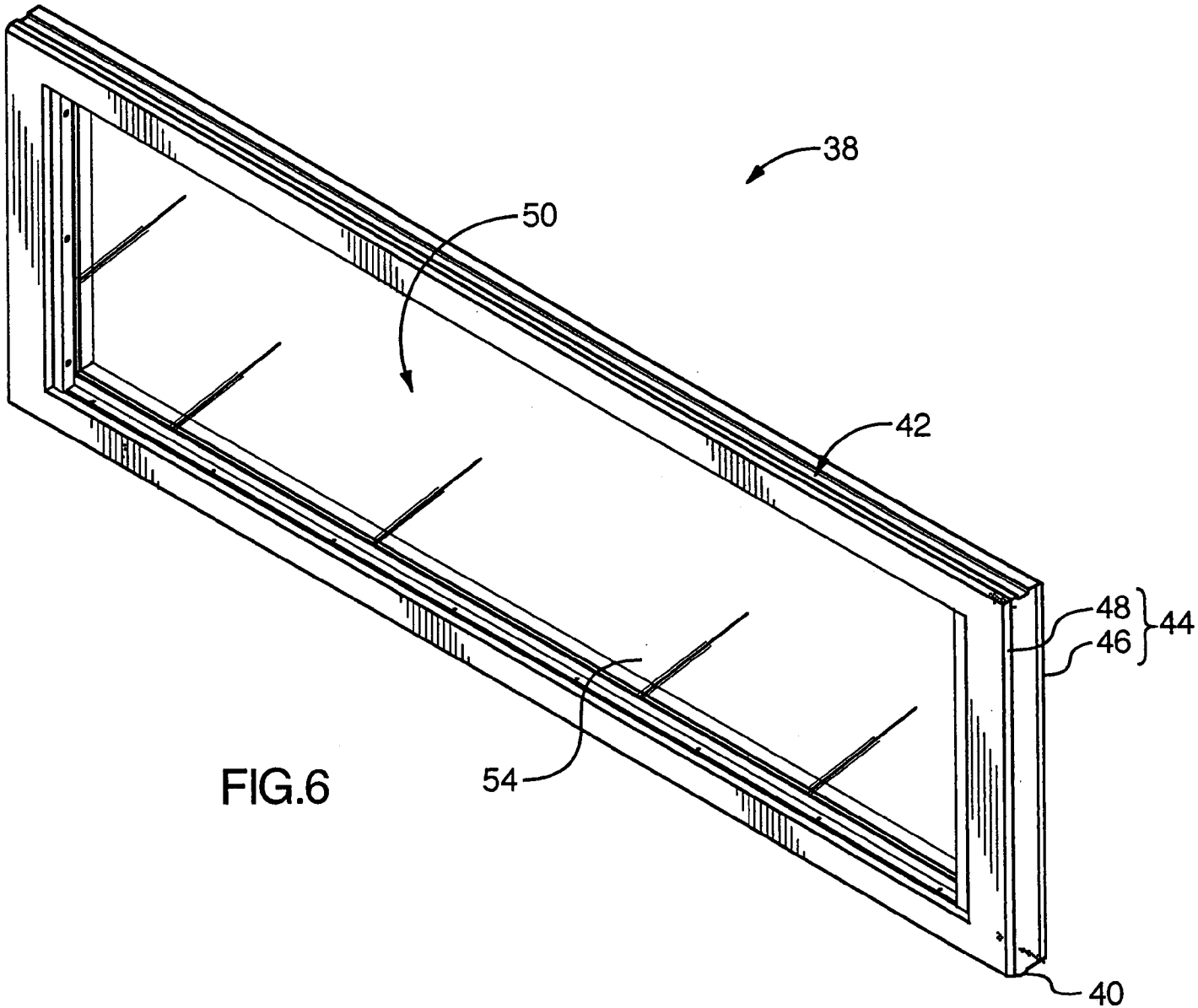
FIG. 6 is a view of the structure of FIG. 5, from a perspective opposite to that of FIG. 5, to show the opposite side of such structure.

Each panel section 36,38 comprises a cementitious body portion 44 including a first layer 46 and a second layer 48 joined as two laminae, as seen representatively in FIG. 5, and is orientated with the first layer 46 thereof facing said sound source (not shown) in use.

The first layer 46 comprises mineralized organic fibrous material blended with cement, specifically, mineralized and neutralized softwood shavings blended with Portland cement, and acts as a sound-attenuating panel because it absorbs sound. As illustrated the first layer 46 of each panel section 38 is preferably provided with a decorative pattern to resemble a natural stone wall. The second layer 48 comprises a fine aggregate concrete, and being more dense than the first layer 46, acts as a barrier to the transmission of sound.

Figure 9:
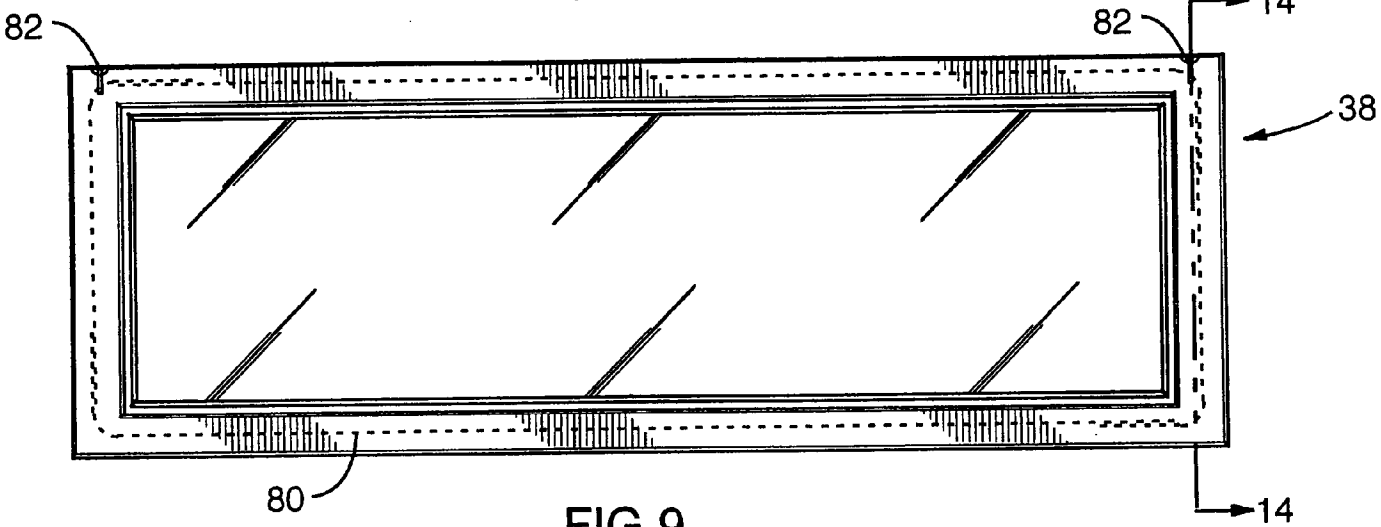
FIG. 9 is a rear elevational view of the structure of FIG. 5.
Figure 10:
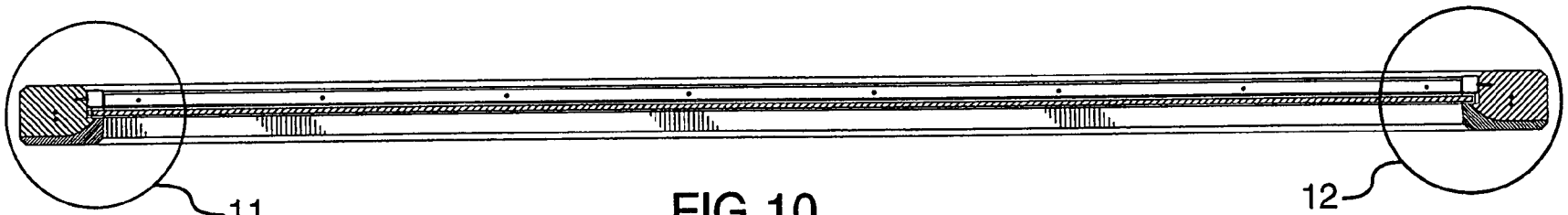
FIG. 10 is a cross-sectional view of the structure of FIG. 5, along section line 10-10 of FIG. 8.
Figure 11:
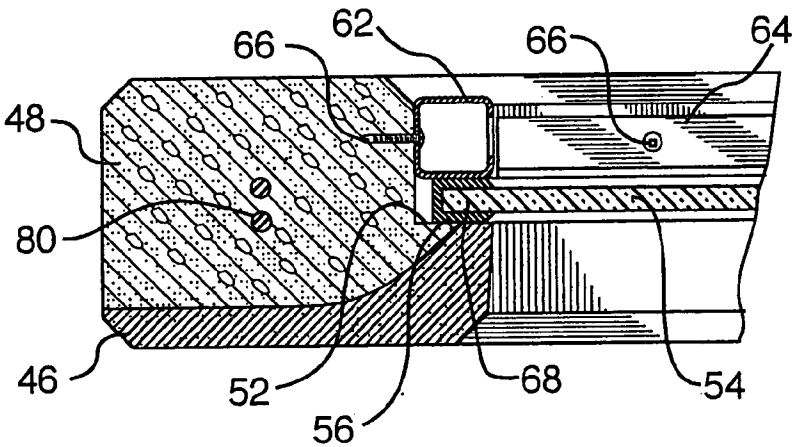
FIG. 11 is an enlarged detail view of the encircled area 11 in FIG. 10.
Figure 12:
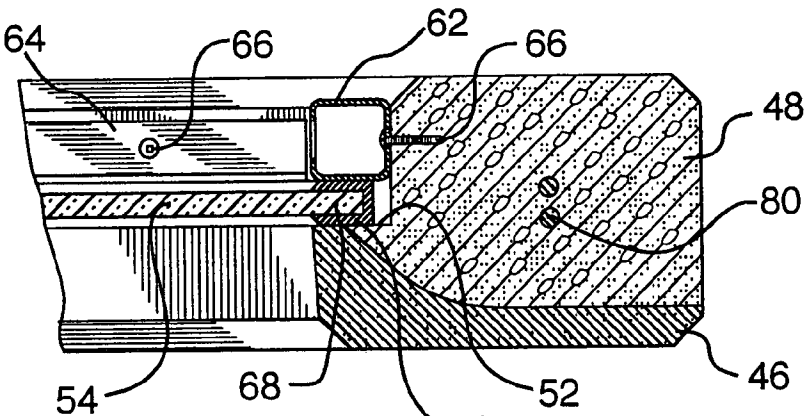
FIG. 12 is an enlarged detail view of the encircled area 12 in FIG. 10.
Figure 13:
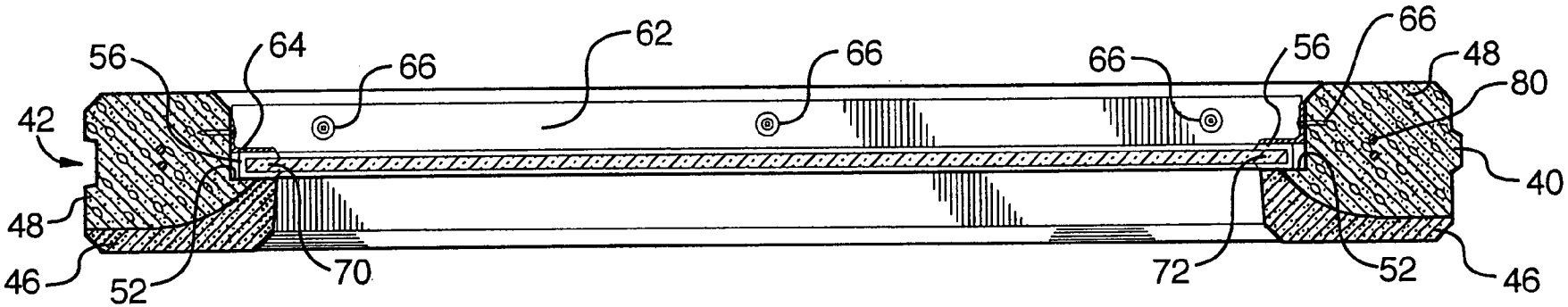
FIG. 13 is a cross-sectional view of the structure of FIG. 5, along section line 13-13 of FIG. 8.
Figure 14:
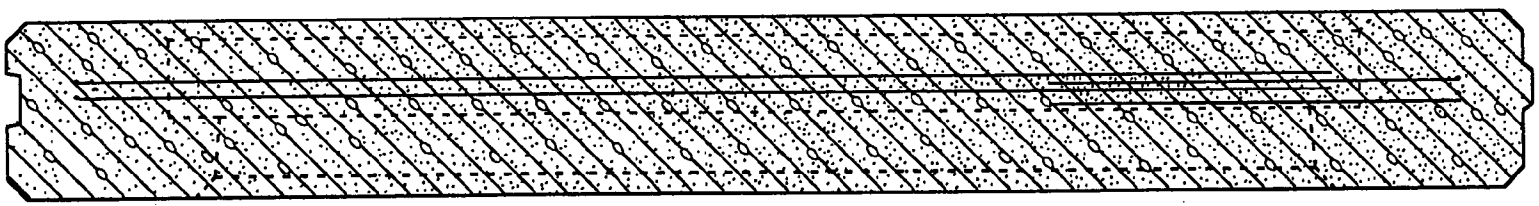
FIG. 14 is a cross-sectional view of the structure of FIG. 5, along section line 14-14 of FIG. 9.

Each panel section 36,38 preferably further comprises reinforcing steel 80 encased in the body portion 44 thereof, as shown in FIGS. 9, 11-14, as well as threaded sockets 82, shown in phantom in FIG. 9, adapted to receive lifting eyes (not shown) and secured to the reinforcing steel 80, to facilitate assembly of the sound barrier 20. A typical panel section 36,38 may have a surface 10 feet by 20 inches and a thickness of about 80 mm.

As will be evident from a review of the illustrations, the panel sections 36,38 assume two general types.

Panel sections of the first type 36 are of conventional construction, and can be disposed in respective vertically-stacked groups to form conventional wall panels (not shown) which may be interleaved within columns in the manner aforementioned to form a conventional sound barrier (not shown) of the common type described in the Docherty et al. patent referenced in the background portion of this patent disclosure.

Panel sections of the second type 38 are improved relative to those of the first type 36 and form part of the present invention; panel sections of this second type are hereinafter referred to as improved panel sections 38.

Figure 7:
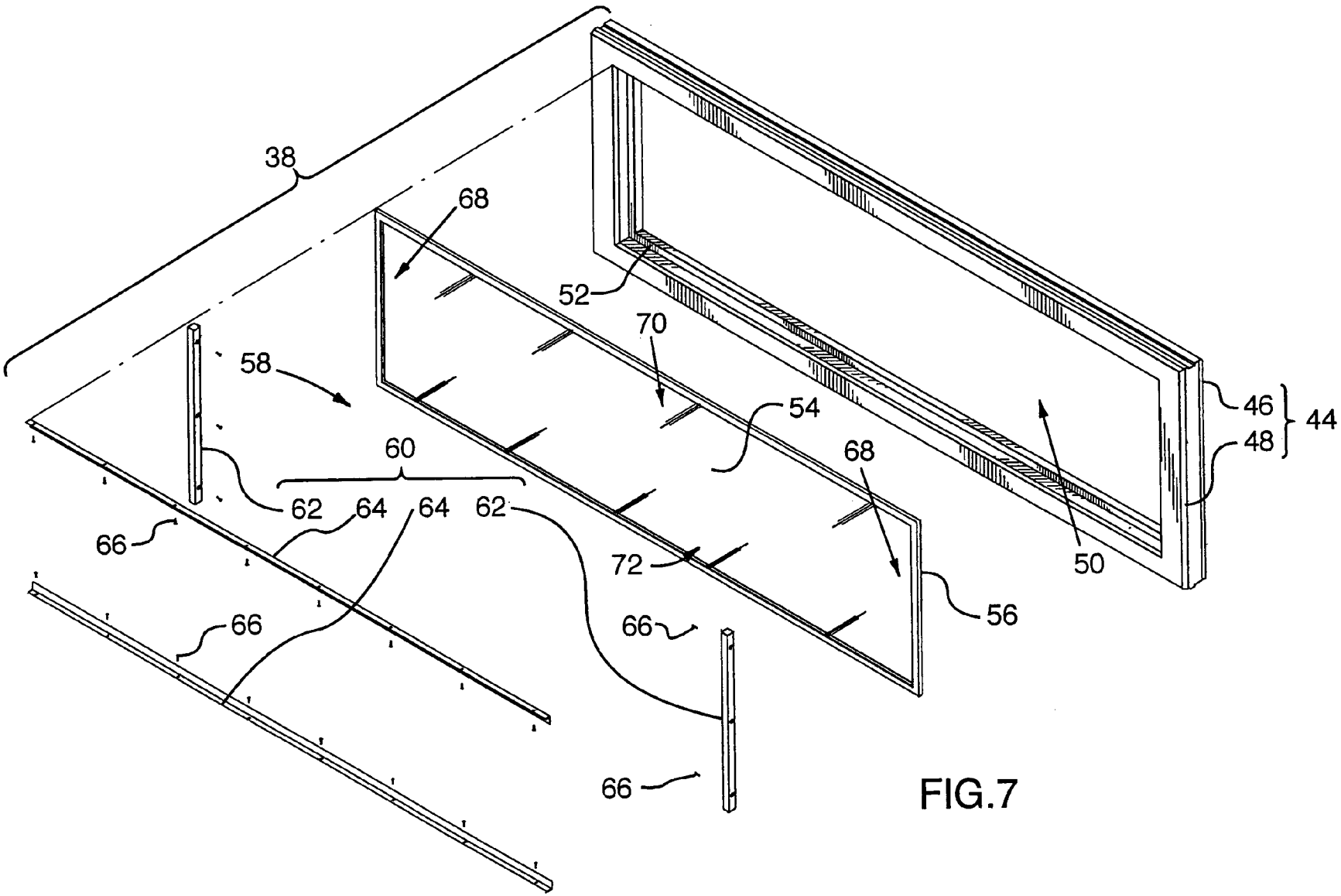
FIG. 7 is an exploded perspective view of the structure of FIG. 6.
Figure 8:
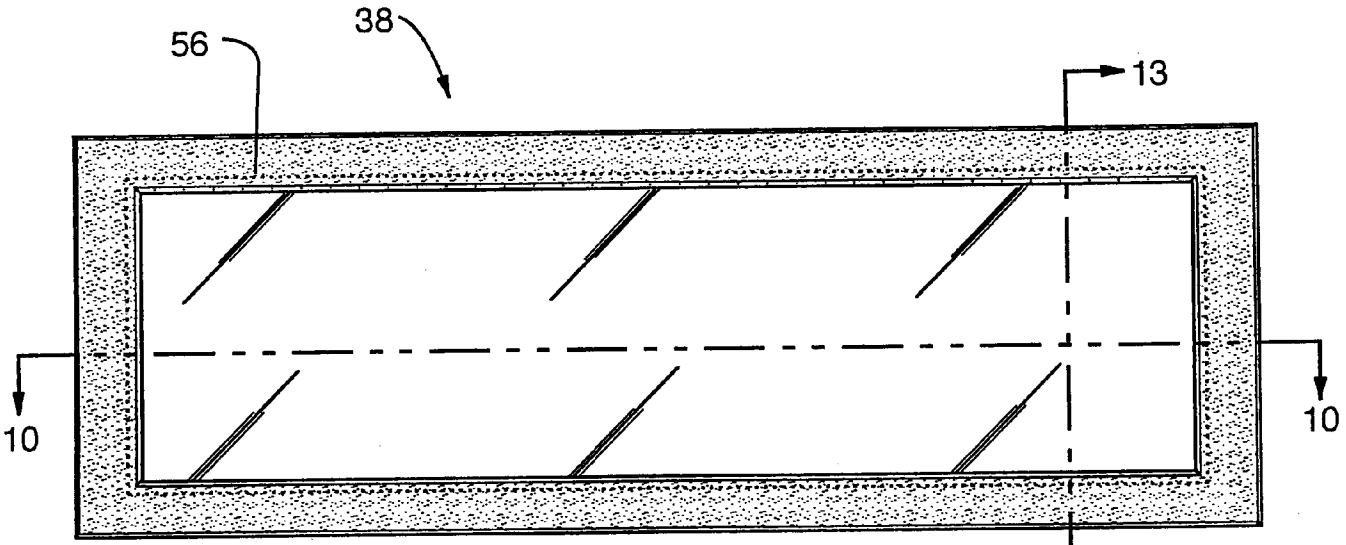
FIG. 8 is a front elevational view of the structure of FIG. 5.

As aspects of said improvement, the body portion 44 of each improved panel section 38 has a window opening 50 defined therethrough for permitting light transmission through said sound barrier in use, and in the preferred embodiment illustrated, has a glaze-receiving surface 52 peripherally surrounding said window opening 50, as best seen in FIG. 7.

As other aspects, each improved panel section 38 has a transparent glazing element 54 adapted for light transmission and, in the preferred embodiment illustrated, a resilient gasket 56 for each glazing element 54, the gasket 56 encasing the periphery of the glazing element 54 and abutting glaze-receiving surface 52, such that the glazing element 54 has its periphery in operative abutment with the glaze-receiving surface 52. The glazing element 54 of the preferred embodiment illustrated is a 15 mm clear transparent acrylic sheet, of the type sold by ROEHM GMBH & CO. KG, of Germany, in association with the trademark PARAGLAS™.

As other aspects of the improvement, a fastening means, designated with general reference 58 in FIG. 7, is provided for securing the glazing element 54 to the body portion 44 to occlude the window opening 50 and to impede the passage of sound therethrough. The fastening means 58 of the preferred embodiment illustrated comprises a locking framework 60, said locking framework 60 being releasably secured to the body portion 44 and positioned to mechanically retain, in sandwiching relation, in combination with the glaze-receiving surface 52, the gasket 56 and the periphery of the glazing element 54 encased thereby.

The locking framework 60 comprises a pair of square tubes 62 and a pair of angles 64. The square tubes 62 are secured to the body portion 44 by concrete screws 66 to mechanically retain, in sandwiching relation, in combination with the glaze-receiving surface 52, side edge portions 68 of the glazing element 54 and portions of the gasket 56 contiguous therewith; the pair of angles 64 is secured, also by screws 66, to body portion 44 to mechanically retain, in sandwiching relation, in combination with said glaze-receiving surface 52, vertically-spaced upper 70 and lower 72 edge portions of said glazing element 54 and portions of the gasket 56 contiguous therewith. Such sandwiching relation is best illustrated in FIGS. 11-14.

In addition to the columns 26 and panel sections 36,38 described above, the improved sound barrier 20 further includes, as illustrated in FIG. 4, for each column 26, a cap member 74 and sheathing segments 76, both constructed out of sound absorptive cementitious material to match the composition of the first layer 46 of the wall panels 24. The caps 74 are decorative elements and are each affixed by mortar or the like to the top of the column 26 for which it is provided. The sheathing segments 76 are secured by clips 78 to the flanges 22 of each column 26, so as to permit vertical movement therealong, and thereby accommodate frost heaving or the like, and are sized to overhang the joints between the panels 24 and the columns 26, so as to render such joints substantially air-tight and thereby improve acoustical attenuation. Additionally included in the preferred embodiment illustrated are light fixtures 84, as shown in FIG. 2, for safety and aesthetics.

While but a single preferred embodiment of the present invention is shown and illustrated, it will be evident that various modifications may be made without departing from the spirit and scope of the invention.

For example, whereas in the preferred embodiment illustrated, three (3) improved panel sections 38 are employed in combination with three (3) conventional panel sections 36 and three (3) columns 26, it should be understood that the invention is not so limited; a wall according to the present invention could readily be constructed out of any desirable number of columns, and solely from improved panel sections or from other combinations of conventional panel sections and improved panel sections (not shown).

Further, such combinations may be readily and conveniently tailored to meet the needs of any given installation. For example, in circumstances wherein sound attenuation was of foremost concern, and wherein light transmission was of secondary concern, a wall could be constructed with only a few improved panel sections interspersed throughout in an aesthetically pleasing arrangement. Alternatively, in circumstances wherein light transmission was of foremost concern, improved panel sections could be utilized exclusively in thee construction of the wall. Thus, the present invention provides a highly flexible sound barrier wall system having transparent or translucent panels that is completely modular in nature.

Moreover, such combinations may be modified from time to time, as needs change. For example, a sound barrier according to the present invention could be constructed alongside a highway, for sound attenuation purposes, which included improved panel sections only in the area of an on-ramp, to improve safety for vehicular traffic; if, over time, dwellings were constructed on the quiet side of the wall, and demanded more light, improved panel sections could be readily substituted from time to time.

Additionally, whereas in the preferred embodiment. illustrated panel sections 36,38 are disposed in use in vertically stacked groups to form wall panels 24, this use is not exhaustive; for example, a single improved panel section, suitably sized, could itself serve a wall panel (not shown).

Further, whereas in the preferred embodiment illustrated, the body portion of each panel section includes only two laminae, it is of course possible to construct a panel section such that the mineralized fibrous material blended with cement is disposed on both sides of a layer of fine aggregate concrete (not shown). A sound barrier constructed from such panel sections (not shown) would tend to absorb noise from both sides, and would continue to reduce the transmission of sound because of the dense central layer. Sound absorption qualities of the sound barrier, of course, may also be tailored through the selection of a distribution of improved panel sections and conventional panel sections, so as to provide any desired ratio of exposed glazing element and absorptive material, and also through modification to the relative proportion of the glazing elements in the improved panel sections.

As well, whereas the columns of the preferred embodiment illustrated take the form of metal I-beams, it will be evident that the columns may be of any suitable material and be of any suitable cross-sectional shape, for example a wide-flange beam, paired channels or paired box sections.

Further, whereas in the preferred embodiment, Portland cement is blended with neutralized and mineralized fibrous material to form the first layer of each panel section, various other binders may be used, such as organic or inorganic cements, hydraulic cements, hydraulic limes, porous binders, as well as other adhesives or glues.

Additionally, whereas the panel sections of the preferred embodiment are constructed in part from softwood shavings, other fibrous material may be utilized, such as hardwood shavings. Vegetable or textile fibres, for example, sugarcane (bagasse), coco fibres, parts of palms, various grasses, cereal plants, plant fibres, reed, papyrus and other sedges, lofas and similar vegetable material as well as inorganic fibres and aggregates, for example, asbestos, glass wool, rock wool and vermiculite could also be used.

Where organic material is used it must be mineralized and neutralized if noxious components exist therein which would adversely affect the binding quality of the cement.

Finally, whereas the glazing element of the preferred embodiment takes the form of a clear transparent acrylic sheet, it will be appreciated that other materials may be utilized, and that the glazing element need not be clear nor transparent, and could, for example, be translucent and/or tinted, if so desired.

In view of such possible modifications, it should therefor be understood that the scope of the present invention is limited only by the accompanying claims, purposively construed.

I claim:

1. In a panel section for use in a sound barrier for acoustical attenuation of a sound source, said panel section having a cementitious body portion; for use with at least two vertically-extending, ground-mounted I-beam columns, each such column having two parallel flanges and a transverse web extending therebetween and being positioned such that its web is substantially parallel to the web of each adjacent column and is substantially normal to a notional wall line defined by said columns; and disposed, in use, in respective vertically-stacked groupings to form one or more wall panels interleaved between adjacent pairs of columns, each wall panel having a pair of end edges disposed, one each, in mechanically-engaged relation, between the parallel flanges of a respective pair of adjacent columns;

the improvement comprising:

the body portion having defined therethrough a window opening for permitting light transmission through said sound barrier in use;

a glazing element adapted for light transmission; and fastening means for securing said glazing element to said body portion to occlude said window opening and to impede the passage of sound therethrough;

wherein said body portion has a glaze receiving surface peripherally surrounding said window opening against which the periphery of the glazing element is operatively abutted; and wherein the fastening means is secured to said body portion in opposed, spaced relationship to the glaze receiving surface, such that said glazing element is bounded on one side by said fastening means, and on its opposite other side by said glaze receiving surface, to retain said glazing element in operative abutment with said glaze receiving surface.

2. An improvement according to claim 1, wherein the body portion includes a first layer and a second layer joined as two laminae, and is orientated with the first layer facing said sound source in use.

3. An improvement according to claim 2, wherein said first layer comprises mineralized fibrous material blended with cement and said second layer comprises a fine aggregate concrete.

4. An improvement according to claim 3, wherein the mineralized fibrous material blended with cement comprises mineralized and neutralized organic fibrous material blended with Portland cement.

5. An improvement according to claim 1, further comprising a gasket encasing the periphery of said glazing element, said gasket abutting the glaze-receiving surface to provide for said operative abutment of the periphery of the glazing element and the glaze-receiving surface.

6. An improvement according to claim 5, wherein the fastening means comprises a locking frameworks with said locking framework being secured to said body portion and positioned to mechanically retain, in sandwiching relation, in combination with the glaze-receiving surface, the gasket and the periphery of said glazing element encased thereby.

7. An improvement according to claim 6, wherein the locking framework is releasably secured to said body portion.

8. An improvement according to claim 6, wherein the locking framework comprises a pair of square tubes secured to said body portion to mechanically retain, in sandwiching relation, in combination with the glaze-receiving surface, side edge portions of said glazing element and portions of the gasket contiguous therewith, and a pair of angles secured to said body portion to mechanically retain, in sandwiching relation, in combination with the glaze-receiving surface, vertically-spaced upper and lower edge portions of said glazing element and portions of the gasket contiguous therewith.

9. An improvement according to claim 1, wherein the glazing element is an acrylic sheet.

10. An improvement according to claim 1, wherein the glazing element is translucent.

11. An improvement according to claim 1, wherein the glazing element is transparent.

12. In a sound barrier having at least two vertically-extending, ground-mounted I-beam columns, each such column having two parallel flanges and a transverse web extending therebetween and being positioned such that its web is substantially parallel to the web of each adjacent column and is substantially normal to a notional wall line defined by said columns; and a plurality of panel sections disposed in respective vertically-stacked groupings to form one or more wall panels interleaved between adjacent pairs of columns, each wall panel having a pair of end edges disposed, one each, in mechanically-engaged relation, between the parallel flanges of a respective pair of adjacent columns, the improvement comprising:

at least one of said wall panel sections being an improved panel section including a cementitious body portion having defined therethrough a window opening for permitting the passage of light through said sound barrier;

a glazing element adapted for light transmission; and fastening means for securing said glazing element to said body portion to occlude said window opening and to impede the passage of sound therethrough;

wherein said body portion has a glaze receiving surface peripherally surrounding said window opening against which the periphery of the glazing element is operatively abutted; and wherein the fastening means is secured to said body portion in opposed, spaced relationship to the glaze receiving surface, such that said glazing element is bounded on one side by said fastening means, and on its opposite other side by said glaze receiving surface, to retain said glazing element in operative abutment with said glaze receiving surface.

* * * * *